US007633356B2

(12) United States Patent
Hamet et al.

(10) Patent No.: US 7,633,356 B2
(45) Date of Patent: Dec. 15, 2009

(54) TUNABLE-INDUCTANCE THIN-LAYERED SUPERCONDUCTOR COMPONENTS, METHOD FOR THE PRODUCTION THEREOF AND DEVICES INCLUDING SAID COMPONENTS

(75) Inventors: Jean-François Hamet, Anguerny (FR); Pierre Bernstein, Villiers le Sec (FR); Laurence Mechin, Caen (FR); Nabil Touitou, Gieres (FR); Séverine Mouchel, Tourlaville (FR)

(73) Assignee: Centre National de la Recherche Scientifique, Paris Cedex (FR)

( * ) Notice: Subject to any disclaimer, the term of this patent is extended or adjusted under 35 U.S.C. 154(b) by 113 days.

(21) Appl. No.: 10/590,086

(22) PCT Filed: Feb. 24, 2005

(86) PCT No.: PCT/FR2005/000445

§ 371 (c)(1),
(2), (4) Date: Aug. 22, 2006

(87) PCT Pub. No.: WO2005/091316

PCT Pub. Date: Sep. 29, 2005

(65) Prior Publication Data

US 2007/0164837 A1 Jul. 19, 2007

(30) Foreign Application Priority Data

Feb. 27, 2004 (FR) ..... 04 02063

(51) Int. Cl.
*H01P 1/203* (2006.01)

(52) U.S. Cl. ..... 333/99 S; 333/156; 505/211

(58) Field of Classification Search ..... 333/99 S, 333/156; 505/210, 211, 700, 701
See application file for complete search history.

(56) References Cited

U.S. PATENT DOCUMENTS 3,717,773 A * 2/1973 Parmentier et al. ..... 327/528
4,558,295 A 12/1985 Olmsted et al.
4,749,888 A * 6/1988 Sakai et al. ..... 326/4
5,426,409 A 6/1995 Johnson (Continued)

FOREIGN PATENT DOCUMENTS

EP 0 716 468 6/1996

(Continued)

OTHER PUBLICATIONS

Cho, Shinho, Park, Jung-Chul and Lee, Cheon; Current and Temperature Controlled Variable Inductance in Superconducting Microstrip Lines; IEEE Transactions on Applied Superconductivity, vol. 11, No. 1, Mar. 2001, pp. 3090-3093.

*Primary Examiner*—James Cho
(74) *Attorney, Agent, or Firm*—Greer, Burns & Crain, Ltd.

(57) ABSTRACT

In the field of thin-layered superconductors, particularly those having tunable or adjustable characteristics, a method for the production of such components is provided, in addition to devices including such components. In such a device, is a stack of thin layers alternately consisting of an electrically insulating material and a superconductor material, and turning structure resulting in a resistive link between at least two of the superconductor layers. The inductance of the component can be adjusted by modifying the resistivity of the link.

22 Claims, 7 Drawing Sheets

U.S. PATENT DOCUMENTS

| | | | | |
|---|---|---|---|---|
| 5,472,935 | A | 12/1995 | Yandrofski et al. | |
| 5,679,624 | A | 10/1997 | Das | |
| 5,872,489 | A | 2/1999 | Chang et al. | |
| 6,013,229 | A * | 1/2000 | Lewis et al. | 422/82.02 |
| 6,148,221 | A * | 11/2000 | Ishikawa et al. | 505/210 |
| 6,185,441 | B1 * | 2/2001 | Wikborg et al. | 505/210 |
| 6,211,753 | B1 | 4/2001 | Leifso et al. | |
| 6,556,415 | B1 | 4/2003 | Lee et al. | |
| 6,841,435 | B2 | 1/2005 | Udagawa et al. | |

FOREIGN PATENT DOCUMENTS

| | | |
|---|---|---|
| JP | 01189206 | 7/1989 |
| WO | WO 97/23012 | 6/1997 |

* cited by examiner

TUNABLE-INDUCTANCE THIN-LAYERED SUPERCONDUCTOR COMPONENTS, METHOD FOR THE PRODUCTION THEREOF AND DEVICES INCLUDING SAID COMPONENTS

CROSS REFERENCE TO RELATED APPLICATIONS

This patent application is the U.S. National Stage of International Application No. PCT/FR05/00445, filed Feb. 24, 2005, which claims the benefit of France Application No. 0402063 filed Feb. 27, 2004.

BACKGROUND OF THE INVENTION

This invention relates to a thin-layers superconductive inductive component, in particular having characteristics of tunable or adjustable inductance. It also relates to a method for producing such components, as well as devices including such components.

This invention belongs to the field of electric and electronic superconductive components for the electrotechnical or electronics sectors, the telephony sector, the antennae and high-frequency passive device sectors, in particular for medical imaging as well as radars and defence electronics.

Thin-layers superconductive inductive components are generally produced by depositing a superconductive film, generally by vacuum methods such as cathode sputtering or pulsed laser ablation, then the definition by lithographic photography of one or more turns. In this technique the size of the device increases with the value of its inductance.

A practical embodiment consists of a coil comprising 5 turns, the external diameter of which is 15 mm, with tracks of 0.4 mm in width at intervals of 0.3 mm having an inductance of 2.12 μH, which is described in the thesis memorandum proposed by Jean-Christophe Ginefri on 16 Dec. 1999 at the Université de Paris XI and entitled <<Antenne de surface superconductrice miniature pour l'imagerie RMN à 1.5 Tesla>>

The technique described above has two main drawbacks:

- the surface occupied by each inductive component is significant. For example, the component described in the preceding paragraph occupies a surface of more than 700 $mm^2$:
- if the component is integrated into a circuit, it is often necessary to connect the end of the inner turn to a superconductive line. This involves a complex method comprising after the depositing and the etching of the turns:
  - a) the depositing and etching of an insulating film,
  - b) the depositing and etching on this insulator of a second superconductive film having properties similar to those of the first film. This last step is particularly delicate as it is necessary to produce an epitaxial regrowth, a technique which is difficult to control. Other methods enabling the depositing of a coil in thin layers exist, but they present production problems identical to those described here.

Moreover, a certain number of methods are known for obtaining inductive components the inductance characteristics of which are easily adjustable, during the production or once implanted in a circuit or an electric or electronic device.

Such an adjustment can be useful in the production stage, for example in order to produce, at low cost, an extensive and homogeneous range of components with different inductances, by changing only a few parameters in the production process.

It is also very useful to have inductive components, the inductance of which can be adjusted subsequently, for example in order to carry out an adjustment or a calibration or a measurement within a device including such components.

The known devices or methods often use an adjustment to the production of the geometric characteristics of macroscopic elements, or a subsequent adjustment of this geometry by a mechanical action. This involves for example adjusting or controlling the position of a ferrite core at the centre of a coil as in the patent U.S. Pat. No. 4,558,295, or of a metal electrode between two dielectric parts as described in the patent U.S. Pat. No. 6,556,415. It can also involve a shift of contact on a conductive track forming a meander deposited in a thin layer, as taught by the US patent application 2002/0190835.

It is also possible to join by electric or electronic connection a certain number of sub-components of known inductance, as the U.S. Pat. No. 5,872,489 proposes, which has obvious limits, for example in terms of number of values obtained and of complexity of production.

Another method is proposed by the U.S. Pat. No. 5,426,409, which consists in controlling by means of a variable current the degree of magnetic saturation of the core of a coil. When the conditions and the frequencies concerned allow, it is also possible to adjust an inductance by means of frequency variation on a semi-conductor material (MESFET GaAs technology, described in U.S. Pat. No. 6,211,753). This type of solution is not however applicable in every case, and is also cannot always be miniaturized beyond a certain limit.

According to the solutions employed, the components obtained can be subject to wear. Often, they have substantial space requirements. They also have limitations in terms of frequency ranges of and/or useable performance ranges.

In addition to the limitations cited above in terms of miniaturization and inductance performance, producing components with varying inductances or adjusting the inductance value of a component therefore presents substantial difficulties.

SUMMARY

An aim of this invention is to remedy these drawbacks by proposing a production method which is simple and less costly than the current methods.

Another aim of this invention is to propose a component which is more efficient than the current components, as a whole or relative to its size.

This objective is achieved with a production method for a superconductive inductive component in the form of one or more line segments or elements, with a surface of the order of a few hundred square microns constituted by a stack of films or thin layers alternatively superconductive and insulating.

It is thus possible to obtain mass production methods, which can be automated, implementing techniques which are known and widely used for depositing thin layers and etching, which contributes to an appreciable reduction in production costs.

In a preferred embodiment of the invention, each film constituting the stack is perfectly crystallized. The device is dimensioned such that under working conditions it is in the Meissner state, i.e. the state in which it has no measurable dissipation under direct current.

The device proposed may be produced using any pair of materials making it possible to produce a stack of films alternatively superconductive and insulating below a temperature called the critical temperature.

Another aim of this invention is to propose an inductive component the inductance characteristics of which can be more easily adjusted during the production, or at a lower cost.

This objective is achieved with an superconductive inductive component comprising a stack of thin layers composed alternatively of an electrically insulating material and a superconductive material, and tuning means producing a resistive connection between at least two of these superconductive layers.

According to one characteristic, this stack is positioned on a superconductive track connected to or integrated in an electric or electronic circuit.

According to a variant embodiment, the connection between two superconductive layers connected by the tuning means has approximately uniform resistance or resistivity within the stack.

According to another variant embodiment, the connection between two superconductive layers connected by the tuning means has variable resistivity or resistance within the stack.

According to one characteristic, the tuning means are applied to all or part of the section of the stack in order to produce a resistive connection between at least two superconductive layers. These tuning means may then comprise a material which is deposited on or adhering to the section of the stack, and which are thus in contact with all or part of the superconductive layers which are situated there.

According to one characteristic, the tuning means include a compound constituted by a polymer including metal particles, deposited on or in contact with all or part of the section of the stack.

The elements of the tuning means which are applied on the section of the stack may be distributed in the form of a single layer, or of several stacked thin layers.

Another aim of this invention is to propose a more reliable component, which is more efficient or with a reduced space requirement, the inductance characteristics of which can be adjusted or tuned after production.

This objective is achieved with a superconductive inductive component comprising a stack of thin layers composed alternatively of an electrically insulating material and of a superconductive material, and tuning means producing a resistive connection between at least two of these superconductive layers. The tuning means then have resistivity characteristics which vary as a function of a physical or chemical variable, termed a control variable, specific to the environment of the component.

This control variable may then be generated or adjusted by transmitter components, thus producing a command for adjusting the inductance of the component according to the invention. This control variable may also only be specific to the environment of the component according to the invention (or only of a part of the component), thus producing a sensor or detection function of this control variable.

The tuning means may have a resistivity or a resistance controlled by:

an exposure or a variation of exposure to a light radiation.

a variation of temperature.

an exposure or a variation of exposure to a magnetic field.

a exposure or a variation of exposure to a electric field.

According to one characteristic, the tuning means comprise means for controlling the resistance or the resistivity of at least one connection between two superconductive layers connected via these tuning means.

According to one characteristic, the control means comprise an electric or electronic circuit for adjusting the electrical resistivity or the resistance between at least two superconductive layers connected via the tuning device.

Another aim of this invention is to propose a production method which is simple and less costly enabling adjustment or tuning of the inductance characteristics of the components produced.

This aim is achieved with a production method for an superconductive inductive component of a determined inductance value, characterized in that it comprises a phase of depositing a stack of alternating superconductive and insulating thin layers on a substrate, followed by a phase of depositing on all or part of the section of this stack at least one tuning layer, of a material producing between a plurality of these superconductive layers an electric connection with a determined resistance or resistivity, chosen according to said inductance value.

Another aim of this invention is to propose a production method which is simple and less costly enabling the production of components the inductance of which can be adjusted after production.

This aim is achieved with a production method for a superconductive inductive component having the characteristics of adjustable inductance, characterized in that it comprises a phase of depositing a stack of alternating superconductive and insulating thin layers on a substrate, followed by a phase of depositing on all or part of the section of this stack at least one tuning layer, producing between a plurality of these superconductive layers an electric connection with a resistance or resistivity which varies as a function of a physical or chemical variable of the environment of this tuning layer.

According to another feature of the invention, an electronic device is proposed which includes an superconductive inductive component comprising a stack of thin layers alternately of an electrically insulating material and a superconductive material, and tuning means producing a resistive connection between at least two of these superconductive layers.

According to one characteristic, such a device may provide filtering or transducer functions.

The superconductive inductive component may comprise tuning means sensitive to light, for example a layer of a photoconductive compound. Such a device may thus be envisaged in order to produce an optoelectronic transducer.

According to one characteristic, the superconductive inductive component may be combined (alone or in a plurality) with one or more capacitive components. The device according to the invention may then be arranged in order to provide a delay line function.

According to a further aspect of the invention, an antenna device is proposed including a superconductive inductive component comprising a stack of thin layers alternately of an electrically insulating material and a superconductive material, and tuning means producing a resistive connection between at least two of these superconductive layers.

Such an antenna device may then comprise one or more delay lines according to the present invention.

Such antennae may be associated with coherent and tuned controls in order to produce a medical imaging device, for example of the MRI type.

Such a medical imaging device may thus comprise at least one antenna including a superconductive inductive component the tuning means of which enables to tune said antenna.

Delay lines according to the invention may also be used in a phase-shift radar device comprising a plurality of antennae each comprising an electronic circuit including a delay line according to the invention, this delay line being arranged such that each of said antennae transmits a signal the phase of which is shifted with respect to that of the neighbouring antennae.

Several variants of carrying out the method may be envisaged for the production of superconductive circuits integrating the invention.

The production method comprises in particular the steps of depositing a superconductive film and depositing the stack of alternately superconductive and insulating films. The method also comprises steps of etching all of the films deposited and selective etching of the stack produced in such a way as to enable the later to remain only at the positions where an inductive component is sought to be implanted. According to the variants, these etching steps may be interposed in different ways and one or more times within the deposition steps.

According to another aspect of the invention, a system is proposed for producing a superconductive inductive component in the form of one or more line segments constituted by a stack of alternately superconductive and insulating films, implementing the method according to the invention.

In a particular form of the invention, this implementation system comprises:

means for depositing a superconductive film on a substrate, means for depositing a stack of alternately superconductive and insulating films on the superconductive film, and means for etching all of the films deposited, these means being arranged in such a way as to enable the later to remain only at the positions where an inductive component is sought to be implanted.

BRIEF DESCRIPTION OF THE DRAWINGS

Other advantages and characteristics of the invention will become apparent on examination of the detailed description of an embodiment which is in no way limitative, and the attached diagrams, in which.

DETAILED DESCRIPTION

The principle used in the component and its production method according to the invention consists of a stack E of thin films, or thin layers, alternately superconductive C1 and insulating C2, associated or not with resistive connections between the superconductive films C1.

Figure 1:
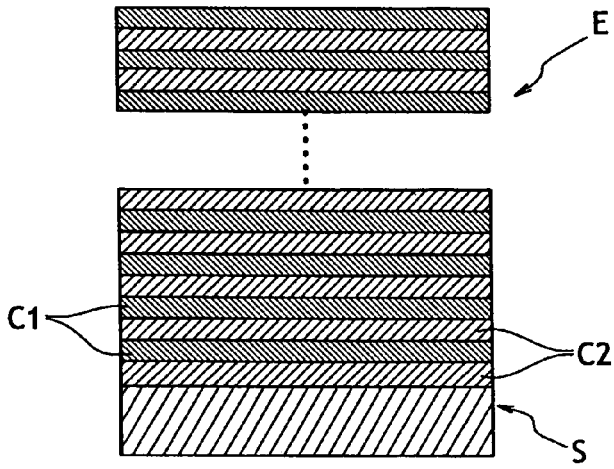
FIG. 1 is a diagram of a stack E of layers $C_1$ and $C_2$ deposited on a substrate.

These films are deposited on a substrate S, with reference to FIG. 1, or on a superconductive line LS. It is important that the films C2 are insulating and that any growth defects which risk bringing two neighbouring superconductive films into direct contact are carefully monitored for.

This stack principle enables components to be obtained with particularly good performance, amongst other things because they have a very high inductance value relative to their size.

The principle consisting of connecting the superconductive layers of the stack to one another via the resistive connections, then makes it possible to reduce the inductance obtained. This reduction may then be planned for and produced as desired, by a variation of the resistance or the resistivity of these inter-layer connections.

It is thus possible to produce components having an inductance of the desired value, according to requirements or in order to constitute a range of components with different values.

By using connections the resistivity of which may vary significantly under the influence of certain factors, it is also possible to produce components the inductance value of which may be modified by control means, or by a physicochemical variable to be detected.

In a preferred embodiment of the invention, the first film deposited in order to produce the stack E is insulating as indicated in FIG. 1.

Figure 2A:
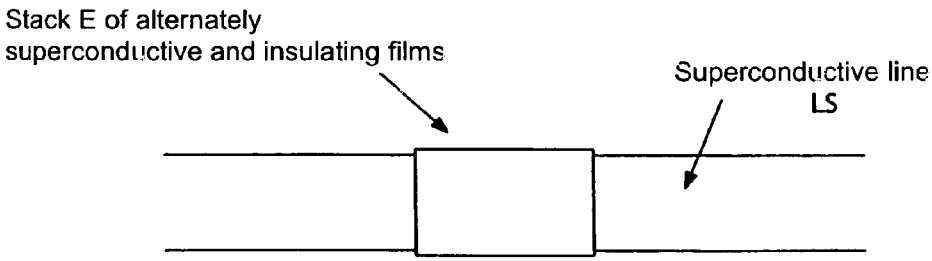
FIG. 2A is a top view of a superconductive line LS comprising an inductive component constituted by alternately superconductive C1 and insulating films C2.
Figure 2B:
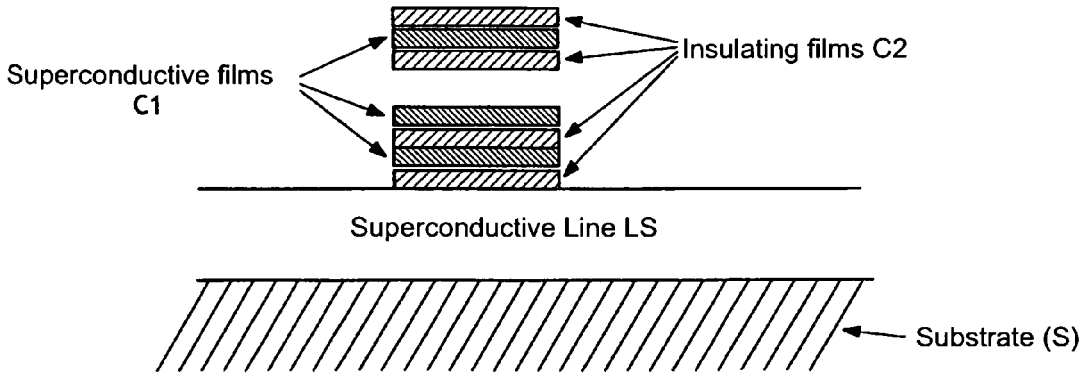
FIG. 2B is a section view of a superconductive line LS comprising an inductive component E constituted by alternately superconductive C1 and insulating films C2.

The integration of inductive components in a superconductive circuit may be carried out in the manner indicated in FIGS. 2A and 2B using the techniques for depositing thin films which are well known to a person skilled in the art, for example laser ablation, radio-frequency cathode sputtering, vacuum evaporation, chemical vapour deposition and in a general way any deposition technique enabling thin layers to be obtained.

It should be noted that in this particular version of the method according to the invention corresponding to FIGS. 2A and 2B, a superconductive film L1 deposited on a substrate S, once etched, constitutes a superconductive line LS on which the inductive stack E will be placed.

In a particular embodiment according to the invention provided by way of non-limitative example, the materials chosen are the compounds YBa2Cu3O7-δ for the superconductive films and $LaAlO_3$ for the insulating films. The thicknesses are 10 nm ($10^{-8}$ m) for the superconductive films and 4 nm ($4.10^{-9}$ m) for the insulating films. 14 pairs of films were deposited.

Figure 3A:
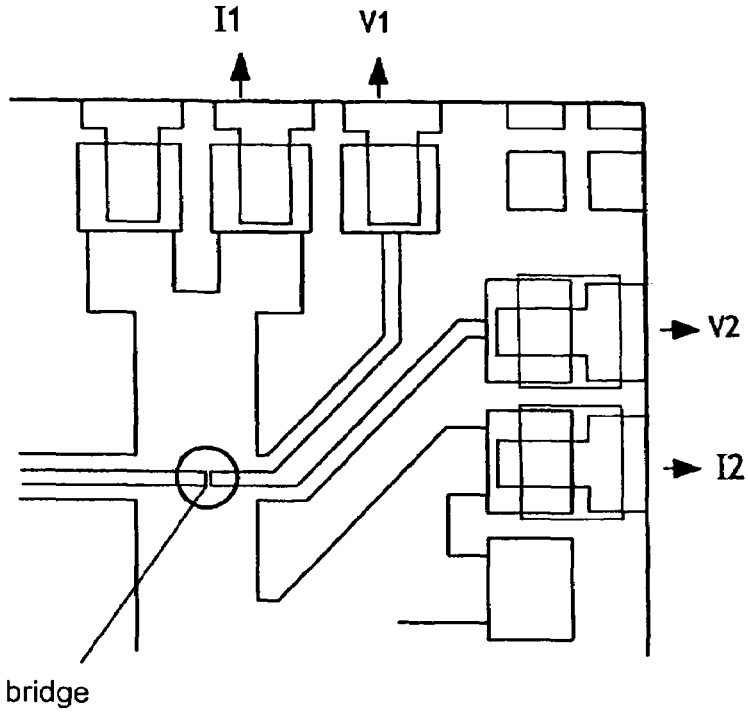
FIG. 3A is a picture of the pattern used for the tests showing the position of the lead-in wires I1 and I2, the contacts V1 and V2 for measuring the potential difference at the terminals of the bridge as well as the position of the latter.
Figure 3B:
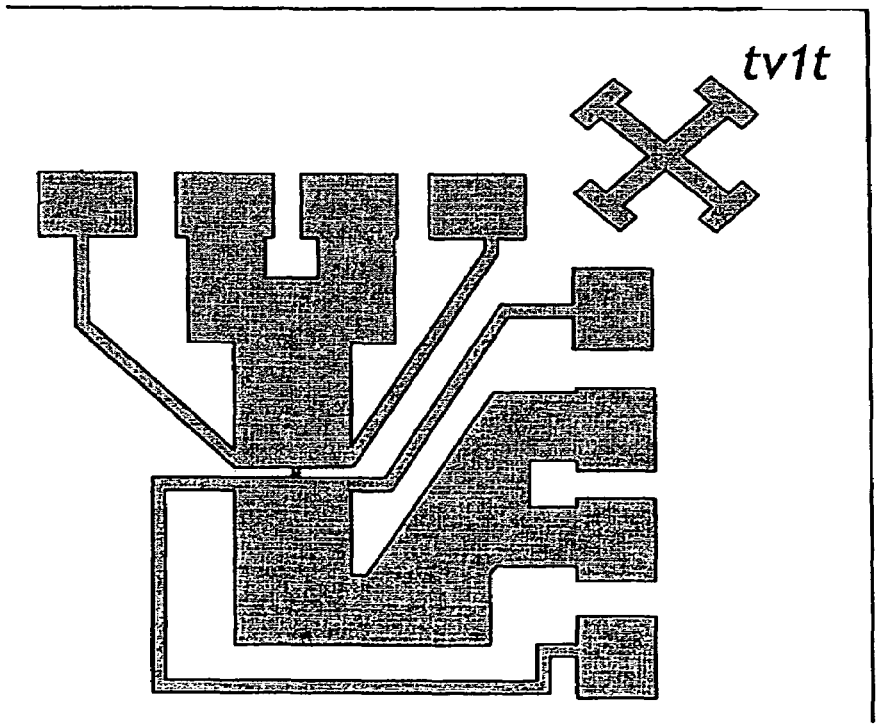
FIG. 3B represents the photolithography mask used to produce the test pattern of FIG. 3A.

After deposition, the films were etched so as to obtain the pattern represented in FIG. 3A in which the metallized contacts I1, I2 which make it possible to introduce the current into the sample and those which make it possible to measure the voltages V1 and V2 at the terminals of the central element, called a bridge, of the pattern. By way of a non-limitative example, the size of the bridge is 10 μm×20 μm.

Figure 4:
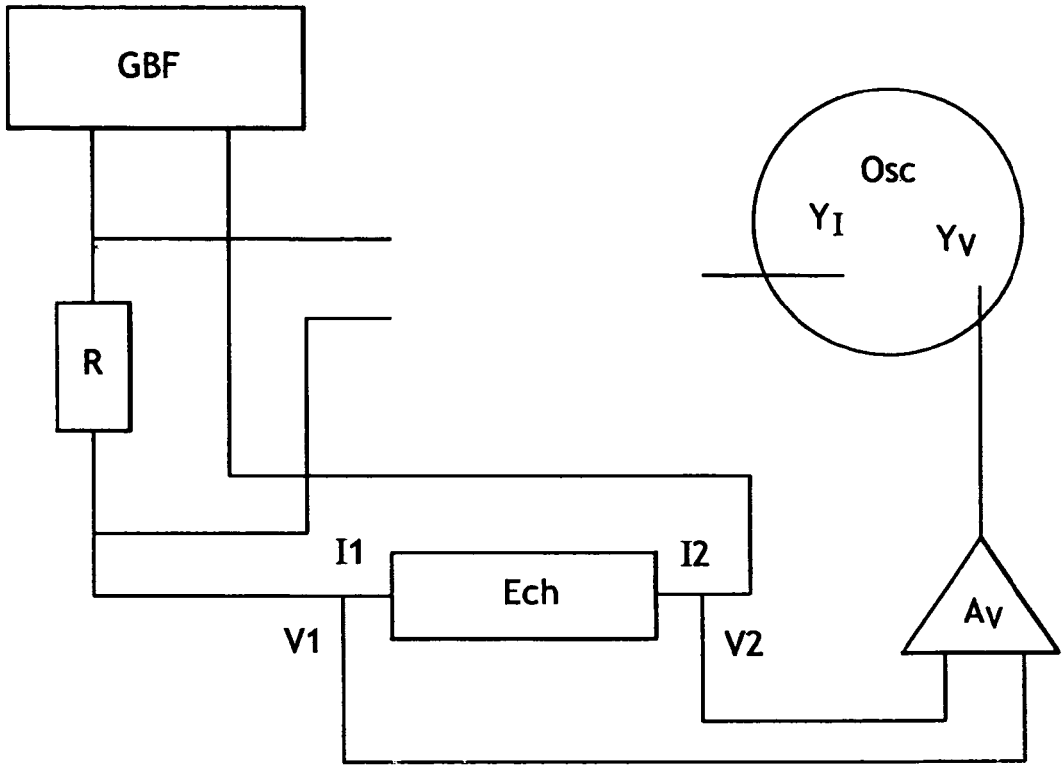
FIG. 4 is a diagram of the measurement device used to characterize a superconductive inductive component according to the invention.

The measurement device used in order to characterize the samples of superconductive inductive components according to the invention, represented in FIG. 4, comprises a GBF generator creating a variable current over time I(t) which passes through the resistance R and the sample Ech via the contacts I1 and I2. The potential difference at the terminals of the resistance R is amplified by a differential amplifier AI and sent to an input YI of the oscilloscope Osc. It enables to know the intensity I(t) of the current passing through the sample. The potential difference at the terminals of the sample is taken at V1 and V2, amplified by the amplifier Av and sent to the input Yv of the oscilloscope Osc.

Figure 5:
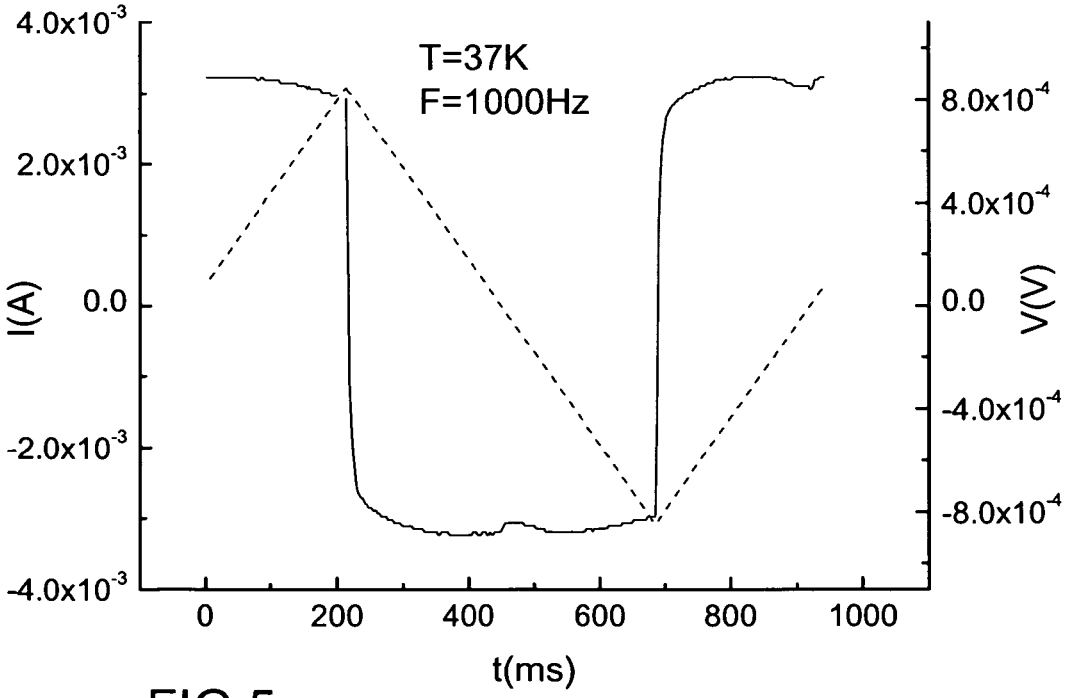
FIG. 5 illustrates a potential difference measured between the contacts V1 and V2 (solid lines) when a sawtooth current (dotted lines) at the frequency of 1000 Hz flows in the sample.

FIG. 5 shows the signals received at YI and Yv when the sample is at a temperature of 37 K. In the present case, the sample was placed in a liquid helium cryostat, but any method, which enables a temperature lower than the critical temperature of the sample studied to be obtained, is suitable.

The generator delivers a sawtooth current at a frequency of 1000 Hz. The value of the current I(t) was plotted directly. It is seen that the potential difference V(t) between V1 and V2 has the shape of square waves, which indicates that V(t) is proportional to the derivative of I(t) with respect to time. This characteristic indicates that the sample does indeed behave like an inductive component.

Figure 6:
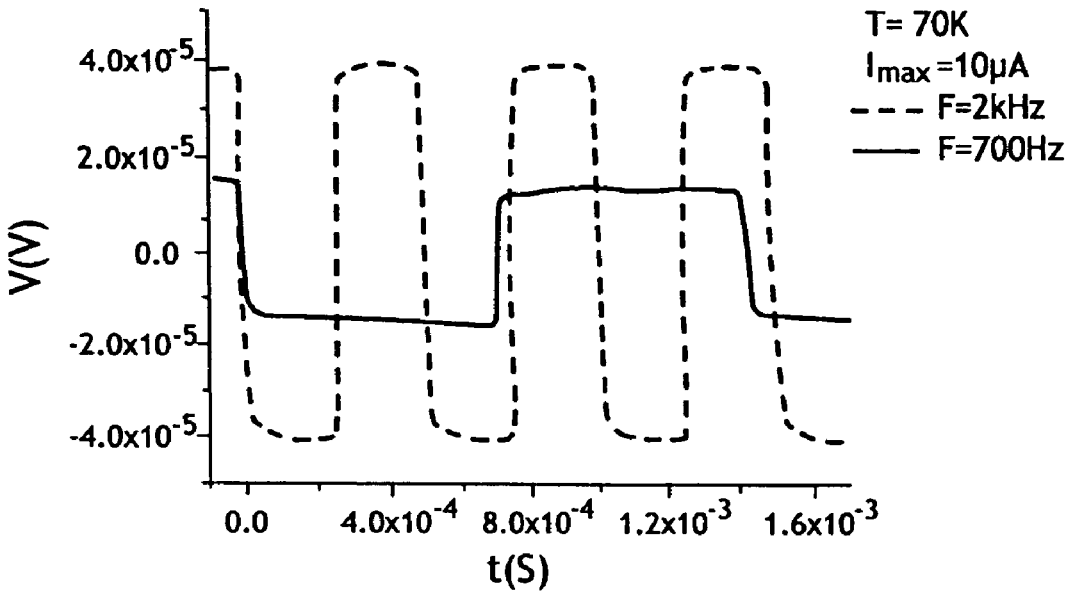
FIG. 6 represents a comparison of the potential differences measured between the contacts V1 and V2 when two sawtooth currents of the same amplitude Imax=10 microamps but with different frequencies flow in the sample.

FIG. 6 shows signals V(t) measured in a similar way at 700 Hz and 2 kHz for a peak current value equal to 10 μA in both cases. In this figure, the solid line corresponds to the voltage plotted for a current with the frequency F=700 Hz and the dotted line to that plotted for a current with the frequency F=2000 Hz.

It is noted that the ratio of the amplitude of the signals obtained is in the ratio of the frequencies applied, which is again typical of an inductive component.

From the results presented in FIG. 6, it is deduced that the inductance of the component produced according to the invention is equal to 535 μH±10 μH. The components tested did not all present such a high inductance but values of the order of several tens of μH have been commonly obtained with components with an identical form to that presented here.

Figure 9:
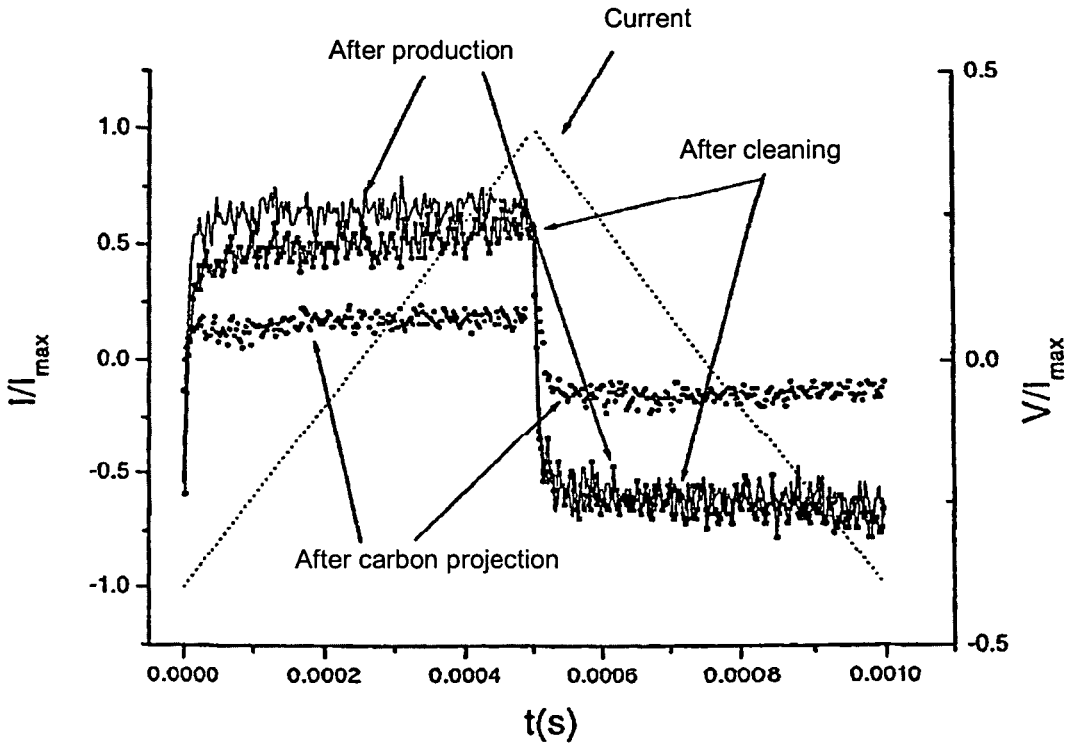
FIG. 9 illustrates a potential difference measured between the contacts V1 and V2 when a current (dotted lines) flows between the inputs I1 and I2, as a ratio to the maximum value of this current, before (solid lines) and after (scatter diagram) exposing the sample to a flow of carbon particles.

FIG. 9 corresponds to several measurements carried out on one initial sample, and demonstrates a variation in the inductance of the component due to the presence of resistive connections between the superconductive layers.

This FIG. 9 shows the signals received at YI and Yv, as a ratio to the maximum value Imax of the intensity and for a frequency of 1 kHz, under the same conditions as for FIG. 5.

In this figure, the solid line represents the quantity V/Imax, measured on a sample the superconductive layers C1 of which are separated by rigorously insulating layers C2. This plot may be used as a reference and corresponds to a maximum inductance obtained for a stack of fixed characteristics both geometrically and in the nature and number of layers. The calculation shows that the inductance of the sample is 62 μH in this configuration.

The sample is then exposed to a flow of carbon particles creating resistive connections between the superconductive layers C1 of the stack E, by contact at the level of the accessible sections of the stack.

The scatter diagram plot represents the quantity V/Imax, measured after this exposure, in the presence of the carbon particles deposited on the section of the stack E. The calculation shows that the inductance of the sample is then 14 μH.

In this configuration, the carbon particles in contact with the superconductive layers C1 at the level where they are flush with the section of the stack E then constitute tuning means produced between these superconductive layers C1 a resistive connection, of low resistance relative to that of the insulating layers C2 which separate them. The experiment also shows that the removal of these carbon particles enables the initial properties to be restored.

Figure 10:
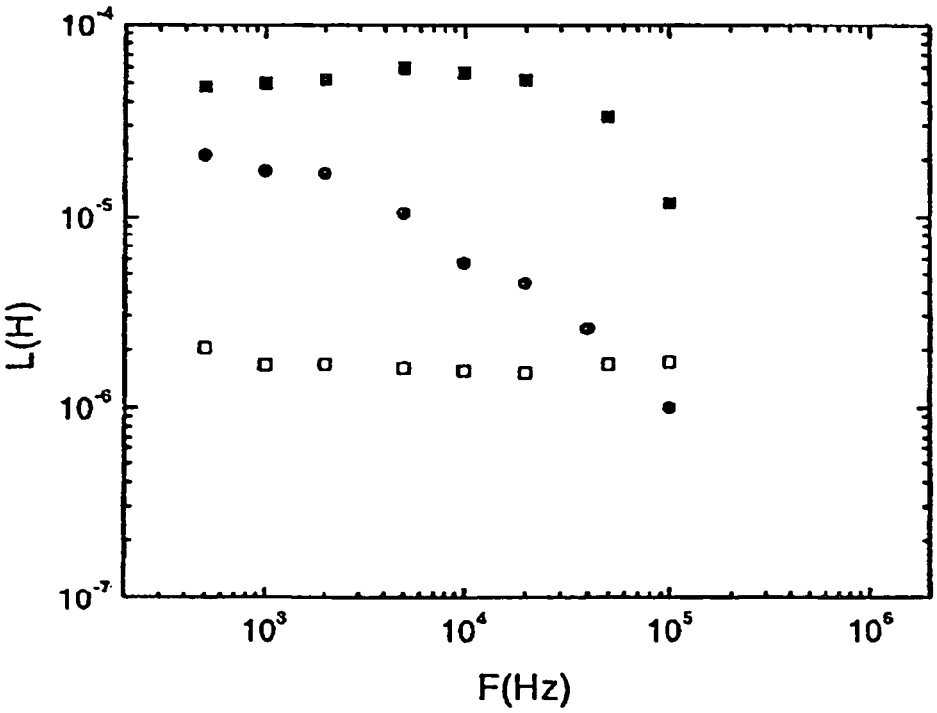
FIG. 10 illustrates inductance values according to the frequency, before (square points) and after (round points and empty points) two different operations are applied producing a resistive connection between the layers of the sample.

FIG. 10 shows the inductance values obtained for a sample similarly with the same shape as for FIG. 5, composed of superconductive films of the $YBa_2Cu_3O_7$ phase separated by $LaAlO_3$ insulating films.

In this figure, the points in the shape of black squares represent the inductance values measured at different frequencies, measured on a sample the superconductive layers C1 of which are separated by rigorously insulating layers C2.

On the same figure, the points in the shape of black circles and in the shape of empty squares represent the inductance values measured at different frequencies, measured on a sample endowed with tuning means of two different types and producing between the superconductive layers C1 resistive connections with different characteristics.

These tuning means may comprise, by way of example, a polymer containing grains of silver applied to the sample.

Thus it is noted that the use of tuning means with different resistances or resistivities makes it possible to produce, starting with a sample of a given inductance, for example of approximately $5.10^{-5}$ H at 1 kHz, a component with lower inductance.

Moreover, this lower inductance value is different depending on whether the tuning means are of a first type with a first resistance characteristic, for example producing an inductance close to $1.1\times10^{-5}$ H, or are of a second type with a second resistance characteristic, for example producing an inductance close to $1.1\times10^{-6}$ H.

The production of these tuning means uses known techniques and may be carried out according to different methods certain of which are explained below by way of non-limitative examples.

Figure 11:
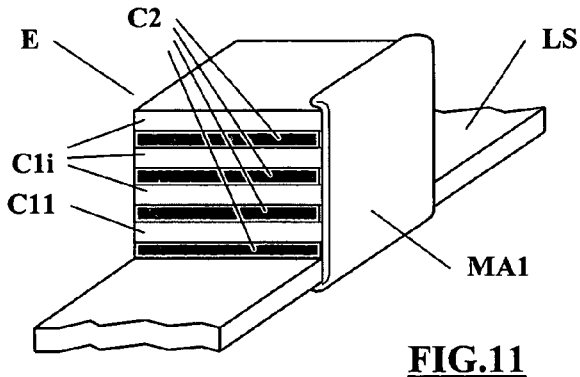
FIG. 11 represents a diagrammatic view in perspective of a component according to the invention, in an embodiment where the tuning means comprise a layer of a compound applied to a section of the stack.

FIG. 11 illustrates an embodiment of the invention where a stack E of thin layers which are alternately superconductive C1 and insulating C2 is positioned on a superconductive track LS. This track may be situated on an insulating film, or directly on a substrate, or may itself be part of a multilayer circuit.

On the section of the stack E a tuning device is arranged producing tuning means, by ensuring an electrical connection with a determined resistance between the different superconductive layers C1, C1*i* of the stack. This tuning device may be produced in the form of a substance MA1 of a known resistivity, which is either fixed or may be chosen by a modification of its composition. This substance, termed a tuning substance, may be deposited on the section of the stack, or on the whole surface of the component, by known means for example by coating or by methods for depositing a thin layer such as those described above.

The resistivity of this tuning substance or the quantity applied, and therefore the inductance of the component obtained, may be chosen and determined before its application on the stack by any known means, for example by analysis of a component at the start of its production. If this substance is a polymer including grains of silver, the inductance of the component produced may thus be determined by the quantity or the size of the grains of silver.

Therefore, the invention also describes a production method for superconductive components with tunable inductance, the inductance value of which is determined at the time of production by the choice of tuning substances with different characteristics.

Figure 12:
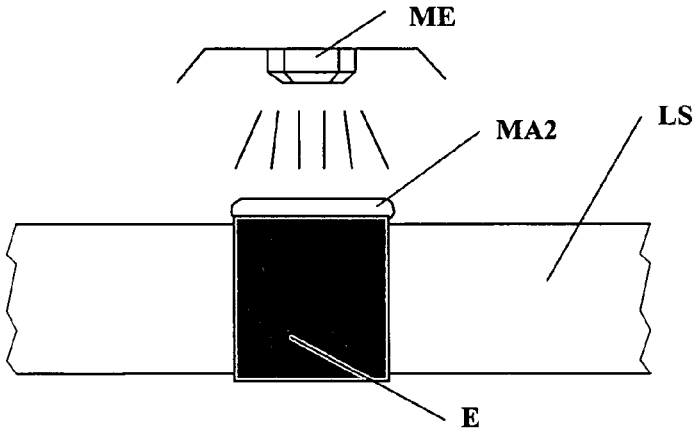
FIG. 12 represents a diagrammatic top view of a component according to the invention, in an embodiment where the tuning means comprise a photoconductive film applied to a section of the stack, and the resistance or the resistivity of which is controlled by a controlled light source.

FIG. 12 illustrates an embodiment where the tuning means have a resistance the value of which changes to a significant extent as a function of a physical or chemical variable of its environment. In this example, the tuning means include a tuning substance MA2, for example a photoconductive film in one or more thin layers, the resistivity and therefore the resistance of which varies as a function of the light radiation that it receives.

This tuning substance MA2 receives a light radiation coming from the lighting means ME, which may be controlled by control means of a known type.

Within an electric or electronic device including a superconductive component with tunable inductance according to the invention, it is therefore possible to control a variation of the inductance of said inductive component by controlling the operation of the lighting means ME. Such a component may thus make it possible to produce numerous types of optoelectronic components, for example an optoelectronic transducer.

By arranging the component according to the invention in such a way that the tuning means receive external light, it is also possible to produce a light sensor.

In another embodiment, not represented, the tuning means have a resistivity and therefore a resistance which varies according to another physical or chemical variable, called a control variable. By way of example, this control variable may be a temperature, an electric field, or a magnetic field.

In the same way as with a light radiation, the component according to the invention may thus be arranged in order to produce a sensor of this variable, or in order for its inductance to be controlled by a generation or a variation of this variable by a controlled source.

Thus, it is possible for example to produce transducers, coupling devices, sensors, or a number of components or devices including a variation of inductance according to such a physico-chemical variable.

The invention therefore also describes a production method for superconductive components with tunable inductance, the inductance value of which is controllable after production by the detection or the control of an exposure or a variation of exposure to a physical or chemical variable specific to the environment of the component.

Figure 13:
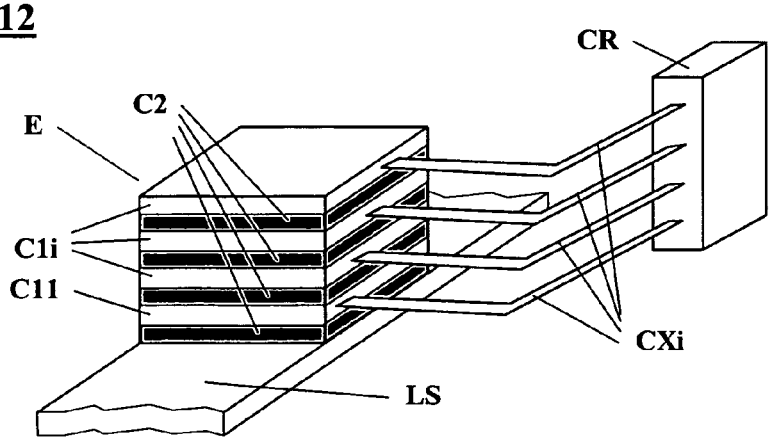
FIG. 13 represents a diagrammatic view in perspective of a component according to the invention, in an embodiment where the tuning means comprise an electric or electronic circuit with adjustable resistance connected to some of the layers of the stack.

FIG. 13 illustrates a variation of the invention which may also be broken down into numerous embodiments. By way of example, an embodiment is represented where a plurality of superconductive layers C1*i* of the stack E receive an individual electrical connection CXi, or in small groups, which connect them to a control circuit. Using known control means, this control circuit establishes between the different connections CXi resistive connections which may be modified according to the inductance to be obtained in the inductive superconductive component. Such connections CXi may be produced, for example, by a discreet connection of the superconductive layers C1*i* using wires or tracks made of normal metal. They may also be produced in the form of thin layers of normal metal forming electrical tracks and stacked at the same time as the superconductive C1*i* and insulating C2*i* layers of the stack E.

The inductive superconductive components obtained by the method according to the invention may have applications in the fields of electrical engineering or electronics, telephony, antennae and high-frequency passive components, in particular for medical imaging as well as radars and defence electronics.

In a first application example, inductive superconductive components are implemented in antenna systems. Thus, in a certain number of cases, for example in medical imaging by surface magnetic resonance (MRI), tuned antennae are used. An important parameter involved in the efficiency of the antenna is the Q-factor ("Quality factor") which is proportional to its inductance. A superconductive antenna makes it possible to increase this factor since its ohmic resistance is very low. It may be expected to obtain another increase in the Q-factor by including in the antenna circuit a device of the sort of those described here.

A particularly favourable case is that where the antenna itself is produced from a thin superconductive film.

Figure 7:
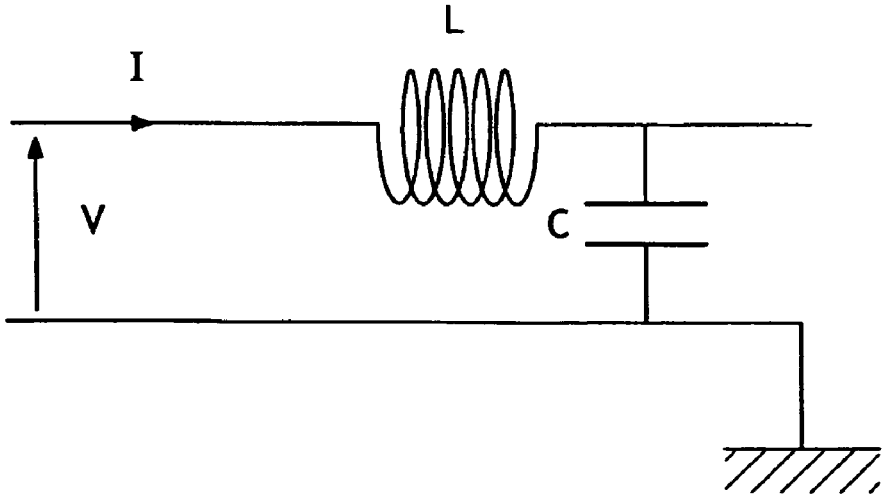
FIG. 7 illustrates a delay line implementing a superconductive inductive component according to the invention.

In another application example, superconductive inductive components are used in delay lines. Delay lines are commonly used in all electronics fields. The simplest form that a delay line may take is represented in FIG. 7.

Figure 8:
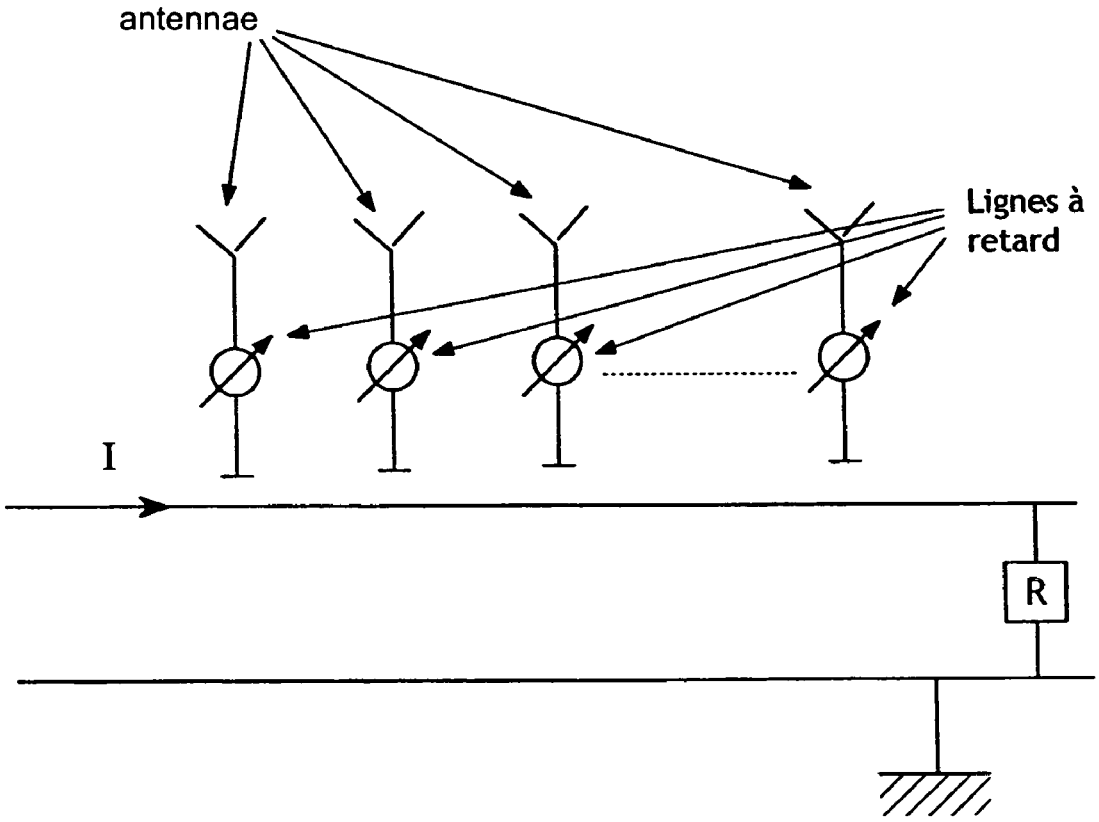
FIG. 8 illustrates a schematic diagram of a phase-shift antenna.

The presence in the circuit of the inductance L and the capacitor C produces a phase difference between the voltage V and the current I. One example of use is that of phase-shift radars which make it possible to explore the surrounding space with a system of static antennae. A schematic diagram for such a system is shown in FIG. 8. In this device the main line carrying the current I is coupled to the different antennae. Each of these contains a delay line in its circuit. This results in each antenna transmitting a signal the phase of which is shifted relative to that of the neighbouring antennae. By varying this phase shift the direction of the radiation transmitted is changed. In defence electronics, the introduction of superconductive components into electronic circuits has been studied for a long time, in particular for radars and more generally for counter measures. The presence of components with high inductance and small dimensions and the production of which uses methods similar to those employed for the rest of the circuit would be an important innovation in this field.

When it is employed, in particular in order to produce delay lines and individual antennae, or composite phase shift antennae, the inductive component according to the invention may be used in versions with different inductance values, produced as described above.

In such applications, the tunable inductive superconductive component according to the invention may also be advantageously used in a version which is adjustable during use, for example in order to modify or calibrate the characteristics of a composite antenna or an active antenna, by differentiated control of the inductance in the delay lines of the individual antennae of which it is composed.

Such individual or composite antennae including the tunable superconductive inductive component according to the invention may also enable useful advances in the fields where tuned antennae are used, for example in medical imaging by surface magnetic resonance (MRI).

In fact, superconductive inductive components are often used with or in antenna systems, and, advantageously, an antenna may itself be produced from a superconductive thin film. It is then possible to carry out a tuning of an antenna by choosing or controlling the inductance of one or more of the inductive components included in it. An important parameter involved in the efficiency of the antenna is the Q-factor which is proportional to its inductance. A superconductive antenna makes it possible to increase this factor as its ohmic resistance is very low. It may be expected to obtain another increase in the Q-factor by including in the antenna circuit a device of the sort of those described here.

A particularly favourable case is that where the antenna itself is produced from a thin superconductive film.

Of course, the invention is not limited to the examples which have just been described and numerous adjustments may be made to these examples without exceeding the scope of the invention. Thus, the number of respectively insulating and superconductive films is not limited to the examples described. Moreover, the dimensions of the superconductive inductive components as well as their surfaces may vary according to the specific applications of these components. In addition, the respectively superconductive and insulating films may be produced from compounds other than those proposed in the example described, provided that these compounds satisfy the physical conditions required for the applications.

The invention claimed is:

1. A superconductive highly inductive component comprising: at least two terminals, said component having at least one line segment incorporating at least one terminal of the component, said line segment constituting a conducting or superconducting layer within a stack of thin layers of alternately an electrically insulating material and a superconductive material, said stack including a plurality of layers of said insulating material and a plurality of layers of said superconductive material, said component further including tuning means producing a resistive connection between at least two of said superconductive layers.

2. The component according to claim 1, characterized in that said stack is positioned on a superconductive track.

3. The component according to claim 1, wherein a connection between two of said superconductive layers connected by the tuning means has more or less uniform resistance in said stack.

4. The component according to claim 1, wherein a connection between two of said superconductive layers connected by the tuning means has a variable resistance within said stack.

5. The component according to claim 1, wherein the tuning means comprise at least one substance applied to all or part of the section of said stack so as to produce a resistive connection between at least two superconductive layers.

6. The component according to claim 5, characterized in that the tuning means have resistance characteristics which vary as a function of a physical or chemical variable, termed a control variable, specific to the environment of the component.

7. The component according to claim 5, wherein the tuning means have a resistance controlled by an exposure or a variation of exposure to a light radiation.

8. The component according to claim 5, wherein the tuning means have a resistance controlled by a variation of temperature.

9. The component according to claim 5, wherein the tuning means have a resistance controlled by an exposure or a variation of exposure to a magnetic field.

10. The component according to claim 5, wherein the tuning means have a resistance controlled by an exposure or a variation of exposure to an electric field.

11. The component according to claim 5, wherein the tuning means comprise a compound constituted by a polymer including metal particles.

12. The component according to claim 1, wherein the tuning means comprise means for controlling the resistance of at least one connection between two superconductive layers connected by said tuning means.

13. The component according to claim 12, characterized in that the control means include an electric or electronic circuit for controlling the electrical resistivity or resistance between at least two superconductive layers connected by the tuning device.

14. An electronic device comprising: a superconductive highly inductive component having at least two terminals, said component having at least one line segment incorporating at least one plot of the component, said line segment constituting a conducting or superconducting layer within a stack of thin layers of alternately an electrically insulating material and a superconductive material, said stack including a plurality of layers of insulating material and a plurality of layers of superconducting material, and said component further including tuning means producing a resistive connection between at least two of said superconductive layers.

15. The device according to claim 14, further configured for providing an optoelectronic transducer function.

16. The device according to claim 14, further including a capacitive component and providing a delay line function.

17. The device according to claim 14, wherein said device produces at least one antenna including an inductive superconductive component.

18. The device according to claim 17, being implemented in a medical imaging device comprising at least one antenna including a superconductive inductive component the tuning means of which enable said antenna to be tuned.

19. The device according to claim 16, being implemented in a phase shift radar device comprising a plurality of antennae each comprising an electronic circuit including at least one delay line, said delay line being arranged such that each of said antennae transmits or receives a signal the phase of which is shifted relative to that of the neighboring antennae.

20. A method for the production of a superconductive highly inductive component with a determined inductance value, said component having at least two terminals and comprising at least one line segment incorporating at least one of said terminals, said method comprising: a phase of depositing a stack of alternately superconductive and insulating thin layers on a substrate, said stack including a plurality of insulating layers and a plurality of superconducting layers, said line segment constituting a conducting or superconducting layer within said stack, followed by a phase of depositing on all or part of the section of the stack at least one tuning layer with a material which produces between a plurality of said superconductive layers an electrical connection with a determined resistance, selected according to said inductance value.

21. A method according to claim 20, wherein after the phase of depositing a stack, the component has a so-called intermediate inductance value, and the phase of depositing the tuning layer enables a reduction of the inductance of the component relative to its intermediate inductance.

22. A method for the production of a superconductive highly inductive component having controllable inductance characteristics, said component having at least two terminals and comprising at least one line segment incorporating at least one of said terminals, said method comprising: a phase of depositing a stack of alternately superconductive and insulating thin layers on a substrate, said stack including a plurality of insulating layers and a plurality of superconducting layers, said line segment constituting a conducting or superconducting layer within said stack, followed by a phase of depositing on all or part of the section of the stack at least one tuning layer, producing between a plurality of said superconductive layers an electrical connection with a resistance varying as a function of a physical or chemical variable of the environment of said tuning layer.

* * * * *